United States Patent [19]

Gomi

[11] 4,240,898

[45] Dec. 23, 1980

[54] PROCESS FOR PRODUCING HIGH QUALITY PITCH

[75] Inventor: Shimpei Gomi, Tokyo, Japan

[73] Assignee: Union Carbide Corporation, New York, N.Y.

[21] Appl. No.: 968,771

[22] Filed: Dec. 12, 1978

[51] Int. Cl.[2] ..... C10G 9/00; C10G 9/14

[52] U.S. Cl. ..... 208/40; 208/44

[58] Field of Search ..... 208/40, 44, 131

[56] References Cited

U.S. PATENT DOCUMENTS

| | | | |
|---|---|---|---|
| 2,847,359 | 8/1958 | Beuther et al. | 208/40 |
| 3,673,077 | 6/1972 | Roza | 208/40 |
| 3,794,579 | 2/1974 | Enomoto et al. | 208/40 |

FOREIGN PATENT DOCUMENTS

| | | | |
|---|---|---|---|
| 53926 | 12/1974 | United Kingdom | 208/40 |

OTHER PUBLICATIONS

Hosoi et al., "Chemical Engineering Progress", vol. 71, No. 11, Nov. 1975, pp. 63 to 67.

*Primary Examiner*—Herbert Levine

*Attorney, Agent, or Firm*—Gerald R. O'Brien, Jr.

[57] ABSTRACT

A process is disclosed for producing pitches of high quality in a high yield by subjecting selected crude oil to adiabatic thermal and steam cracking process at a temperature between 700° C. and 1000° C. to produce gases containing ethylene, propylene and the like and a tar pitch having an ethylene-to-acetylene ratio above 5; adjusting the pitch content of the tar pitch in the range between 20 and 80 wt % (if this content is outside this specified range); heat-treating at a temperature between about 450° C. and about 550° C. under a pressure between about 50 and about 150 kg/cm$^2$(G) for about 1 to 15 minutes, and subsequently heat-soaking at a temperature between about 350° and about 450° C. under a pressure between about 0.5 and about 10 kg/cm$^2$(G) for about 15 minutes to 10 hours.

5 Claims, 3 Drawing Figures

PROCESS FOR PRODUCING HIGH QUALITY PITCH

DETAILED EXPLANATION OF THE INVENTION

The present invention relates to a process for producing various pitches of high quality from tar pitch which has been produced by thermally cracking petroleums at high temperatures and, more particularly to a process for producing a pitch of high quality with high yield which comprises adiabatically thermally cracking a suitable starting oil as defined hereinafter in an ACR thermal cracking process using hot steam as a heat medium at a relatively high temperature for a relatively short period of time in a condition that ethylene/acetylene ratio is at least 50 to obtain gaseous hydrocarbons containing olefins such as ethylene, propylene, butadiene and/or light gases such as hydrogen, methane and carbon monoxide; light aromatic compounds, such as benzene, toluene, xylene; and tar pitch as heavy aromatic compounds and subsequently heat-treating the tar pitch to obtain a pitch of high quality.

The starting oil to be cracked in the ACR process is one of the essential elements of the present invention and defined as follows. That is, the starting oil is selected from (1) suitable oil fractions which have been produced by treating crude oils in a suitable process (for example, normal pressure distillation, vacuum distillation, various processings with hydrogen, pyrolysis, solvent extraction) to remove impurities including asphalt fraction (asphaltene), sulfur, metal contents, nitrogen contents to asceptable or allowable amounts and contains heavy oil fractions having a boiling point above 350° C. (such as vacuum gas oil) and (2) crude oils containing the above impurities in acceptable amounts and containing heavy oil fractions having a boiling point above 350° C. Thus, the starting oil of the present invention has a wide distribution of molecular weights ranging from light fractions such as naphtha to heavy fractions, which, together with the thermal cracking conditions of the ACR process, produces a great amount of tar pitch of good quality. Further, this tar pitch is converted into a pitch of high quality with high yield by the heat-treatment of the present invention using a high temperature, a short residence time and a high pressure.

The ACR process which processes the above-defined starting oil should be understood to be the following process (see "Chemical Engineering Progress" Vol. 71, No. 11, November, 1975, pp. 63–67, entitled "Ethylene from Crude Oil").

BRIEF EXPLANATION OF THE DRAWINGS

Referring to FIG. 1, superheated steam is generated in a burner 1 by the combustion of oxygen and fuel (mainly $H_2$ or $CH_4$ or suitable liquid hydrocarbon) to generate a combustion gas of a temperature of about 2000° C. (Also, in another case, a combustion gas containing hot $H_2$, CO etc. may be generated simultaneously with hot steam by changing the ratio of oxygen to fuel.) This steam is supplemented by externally supplied superheated steam which is for temperature control. Preheated starting oil as defined above is injected into the combustion gas at a location downstream of this combustion zone to crack it. The starting oil and the combustion gas are mixed and accelerated by an orifice or throat to enter a diffuser (reactor) 2 where adiabatic cracking is performed. Thereafter, the steam and the reaction product are quenched with quench oil 4 (l) in a quencher 3 and a cooler 4 (provided with a water jacket of high temperature and high pressure which generates steam for heat recovery) and tar pitch and gaseous product are separated in a separator 5, from which the gaseous product is led to a fractionator 6 to separate a stream of light hydrocarbon oil 10. An olefin-rich stream 9 (containing ethylene, acetylene, propylene, butadiene, carbon monoxide, hydrogen, etc.) is led to succeeding refining steps via a separator 7. The reaction temperature of the reactor 2 is about 700°–1000° C., the pressure is less than about 5 kg/cm$^2$(G) and the reaction time is about 3–100 milliseconds. In most cases, a part of hydrogen and methane gases of the produced cracked gases is recycled as a fuel for generating the superheated steam. The tar pitch in the bottom residue of the separator 5 is relatively rich in aromatic rings. A part of the bottom residue of the fractionator 6 (heavy tar) is recycled by a pump 8 as the quench oil 4 (l) and another part is combined with the tar pitch from the separator 5 for refining in succeeding steps. In short, the ACR thermal cracking process in the present invention is a process where the above-defined starting oil is adiabatically thermally cracked in a reactor 2 using steam as a heat medium under the above-mentioned conditions, i.e. a temperature of about 700°–1000° C., a pressure of less than 5 kg/cm$^2$(G), and a time of 3–100 m sec. and a ratio of ethylene/acetylene of more than 5 (weight ratio).

In this case, if the olefines to be produced by the ACR thermal cracking process consist mainly of ethylene, a temperature of 850°–1000° C. is mostly used but generally a reaction temperature of 700°–1000° C. may be used. Sufficient cracking will not be expected below 700° C. while, above 1000° C., not only acetylene in the cracked gases but also carbonacious material in the tar pitch will be undesirably increased.

Incidentally, in this specification, tar is defined as oil having a boiling point between 200° C. and 550° C. and relatively high aromacity and pitch is defined as one having a boiling point above 550° C. Further, tar having a boiling point between 200° C. and 350° C. is called light tar and tar having a boiling point between 350° C. and 550° C. is called heavy tar.

The tar pitch from the ACR process using the above-defined starting oil is of high quality and is relatively large in quantity because of the fact that the tar pitch is formed under cracking conditions of relatively high temperature and short time from a starting oil containing relatively heavy fractions. That is, the ACR process in the present invention is characterized in that the thermal cracking is performed in an adiabatic condition using a high temperature steam as internal heat medium for a short period of time thereby to make it possible to sufficiently crack even heavy fractions to give a greater amount tar pitch. For example, in the working examples, the quantity of tar pitch amounts to at least 50 wt% of that of ethylene. Also, because of the reaction conditions which result in production of ethylene and propylene as main products ($E/A > 5$) carbonaceous materials are little formed in the reaction and accordingly the tar pitch contains less quinoline insoluble content (giant molecular materials) and less free carbon content. Further, because of the fact that the tar pitch is from a starting oil containing heavy fractions, the tar pitch is different from that used in the conventional pitch refining process in that it contains fractions of suitably large molecular weights and is rich in aromaticity.

The present invention is based on the discovery that tar pitch of high quality is obtained with high yield by the ACR process wherein the above-defined starting oil is processed in the above-defined conditions, said starting oil containing wide range of fractions ranging from light fractions (such as naphtha) to heavy oil fractions or at least heavy oil fractions having a high boiling point.

Figure 2:
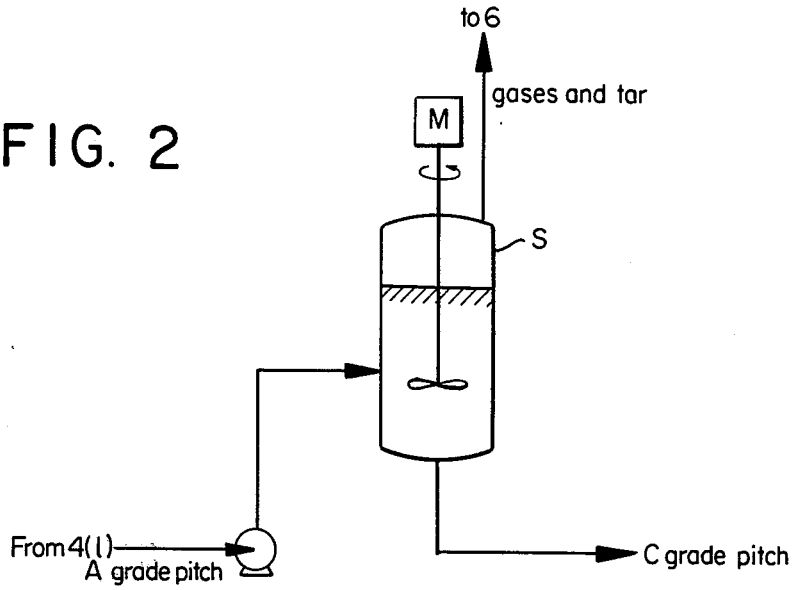
FIG. 2 is a flow sheet showing the conventional process for pitch production applied to the tar pitch formed as a by-product in the conventional ACR process, and, FIG. 3 is a flow sheet showing the pitch production according to the present invention.

In the past, the following process was relied on in preparing pitch from bottom residue of ACR thermal cracking process. That is, referring to FIG. 2, grade A pitch (a pitch having a lower softening point and used as quench oil or impregnation pitch) and the bottom residue of a fractionator of ACR system are pumped with a pump P to a soaker S where the material is treated, typically, at about 370° C. and about 3 kg/cm$^2$(G) for about 40 hours. The unstable components in the tar are converted into pitch, which is then withdrawn from the bottom of the soaker as a binder pitch (grade C pitch). On the other hand, the tar containing light fraction is led from the top of the soaker to the fractionator. In such conventional technique, the tar fraction which is not converted into pitch amounts to a substantial portion and the yield in producing grade C pitch from grade A pitch is lower than the present invention. Also, if the grade A pitch is treated at a higher temperature for a longer period of time in order to increase the yield, there was a possibility that the portion of the pitch having a high softening point is converted into coke or precursor of coke, a part of which sticks to the wall of the soaker. Further, the reaction temperature is relatively low, resulting in a large soaker and high plant and operation costs.

On the other hand, a process similar to the present invention has been proposed by Japanese Patent Application Publication No. 29602/1973 (Shell), wherein a petroleum fraction having a boiling point between 50° and 200° C. or having a boiling point between 170° and 370° C. is thermally cracked at a temperature above 750° C. to produce tar as a by-product, which is then separated into a light fraction and a heavy fraction. The heavy fraction is heated at 350°-500° C. and the product pitch is separated from the resulting product. The treatment is performed for example at 450° C. for 15 minutes or at 350° C. for at least 25 hours while the pressure is less than 15 atm. This prior art technique has a few problems in that the range of molecular weight distribution of the raw material is narrow and hence the tar pitch is less in quantity with respect to the raw material to be cracked that the total pitch yield is low because no particular efforts is made to increase the pitch yield as it states that the fractions having boiling points below 350° C. do not contribute to the production of the pitch (low yield), and that, more importantly, the raw materials are restricted to light ones due to the fact that the thermal cracking reaction is not "adiabatic", with the result that the quantity of tar pitch is less and pitch content in the tar pitch is also less.

On the other hand, the process disclosed in Japanese Patent Application Publication No. 17563/1976 are similar to the process of the above Japanese Patent Application Publication No. 29602/1973 in the point that it utilizes a relatively light starting oil similar to the starting oils in the above-mentioned patent and the tar pitch to be heat-treated is that obtained by using an externally heated tube reactor and hence the total quantity of available tar pitch is restricted. Further, according to the teaching of this patent, the tar pitch is treated under pressure of 20-200 kg/cm$^2$ at temperature of 400°-600° C. for 10-1200 seconds, tar fraction is removed from the by-product tar pitch, and the remaining pitch is treated at 300°-480° C. under pressure of 1-50 kg/cm$^2$ for 1-10 hours. However, as the pitch is produced from the pitch fraction in the tar pitch from which the tar fraction is removed, there is no idea of producing pitch from the tar with high yield and thus the total yield of the pitch is restricted.

This can also be readily seen from the working examples of said application. That is, according to Japanese Patent Application Publication No. 17563/1976, the composition of the starting tar pitch comprises less than about 15% of pitch. Comparing this with about 30 wt% of pitch in the tar pitch obtained according to the present invention, it is seen that the pitch content of the application is low. Further, according to Japanese Patent Application Publication No. 17563/1976, the yield of the pitch is about 40%, based on the starting tar pitch, which is quite different from the yield of more than 60 wt% of the present invention.

Further, looking at these cases from a commercial standpoint, an ethylene production plant by naphtha pyrolysis and an ACR plant, both of the scale of 450,000 tons, produce 15,000-30,000 tons and 200,000-300,000 tons of tar pitch, respectively, and 5,000-10,000 tons and 70,000-100,000 tons, respectively, in terms of pitch content. Thus, from the industrial standpoint they are quite different from each other.

Further, the technique in Japanese Patent Application Publication No. 43641/1977 was proposed by the present inventor et al, in which a crude oil or a suitable petroleum fraction is thermally cracked at 900°-2000° C. for less than 0.1 second, the formed hydrogen, acetylene, olefins and tar materials are fractionated and the separated tar materials are treated at 250°-550° C. for 1 min.-5 hours for refining the materials. The product is separated into pitch fraction and other fractions. However, in this case, as there is given no consideration to the raw material to be cracked, the quality of produced pitch is low when a crude oil is used as the starting oil and low in yield when naphtha is used. Particularly, it should be noted that the thermal cracking is performed in very severe conditions, so that the main product gases of the thermal cracking reaction contain a large amount of acetylene (ethylene/acetylene ratio is less than 5). Correspondingly, the by-product tar pitch contains free carbon and quinoline insoluble in greater amounts compared with the tar pitch from the defined ACR for producing ethylene as a main product using the defined starting oil. Further, looking the matter from the commercial standpoint, acetylene production is restricted in quantity under the present industrial circumstances and accordingly, the quantity of tar pitch, too.

The present invention provides a process for producing pitch of high quality (good thermal stability and superior coking property) with high yield within a much shorter period of time compared with the conventional process without causing carbon deposition, by subjecting a starting oil as defined to an ACR process as defined to form by-product tar pitch, carrying out as processing steps of thusly formed tar pitch a first step characterized by treating the tar pitch for a short period of time (within about 15 minutes) at relatively high temperature and relatively high pressure and then carrying out a second step characterized by treating the tar pitch for a comparatively long period of time (within several hours) at relatively low temperature and low pressure.

The second step is preferably performed in a kettle-type soaker. It has been found that a high efficiency pitch production is made possible in cooperation with the first step performed preferably in a tube heater. The first step mainly converts efficiently those fractions of lower molecular weight in the ACR tar pitch having a wide distribution of molecular weights (by-product tar pitch obtained from adiabatic thermal cracking at 700°-1000° C. with ethylene/acetylene ratio of at least 5) into a heavy tar and a pitch of high aromacity while suppressing evaporation, and on the other hand, decomposes a part of pitch of high molecular weight into gaseous components as well as upgrading tar and pitch components to attain a pitch of high quality. The second step mainly conditions the quality of the product pitch while ultimately converting tar pitch into the product pitch with high yield through polycondensation reaction and the like.

The pitch content of tar pitches to be treated according to the present invention should be controlled within a range of 20-80 wt%, and preferably 25-60 wt%. Pitch content below 20 wt% will increase the process cost and make the process uneconomical while pitch content over 80 wt% will cause carbon deposition, thereby making the operation difficult.

Tar pitch produced by thermal cracking processes other than the ACR process may be introduced into the tar pitch treatment process according to the present invention as a minor constituent. For example, conventional ethylene bottom oil which is a by-product of the conventional process of ethylene production using the conventional tubular furnace such as in Japanese Patent Application Publication Nos. 17563/1976 and 29602/1973 may be treated according to the present invention. Other tar pitches which have a relatively high aromaticity and a carbon/hydrogen (atomic) ratio exceeding 1/0.65 (or specific gravity exceeding 0.95 at 15°/4° C.) and having low asphaltene content may be treated in the present process as a minor constituent to produce pitch products rich in aromaticity. However, the yield and the quality of the product pitch are inferior to those of pitch product produced using only the tar pitch of the ACR process.

Figure 1:
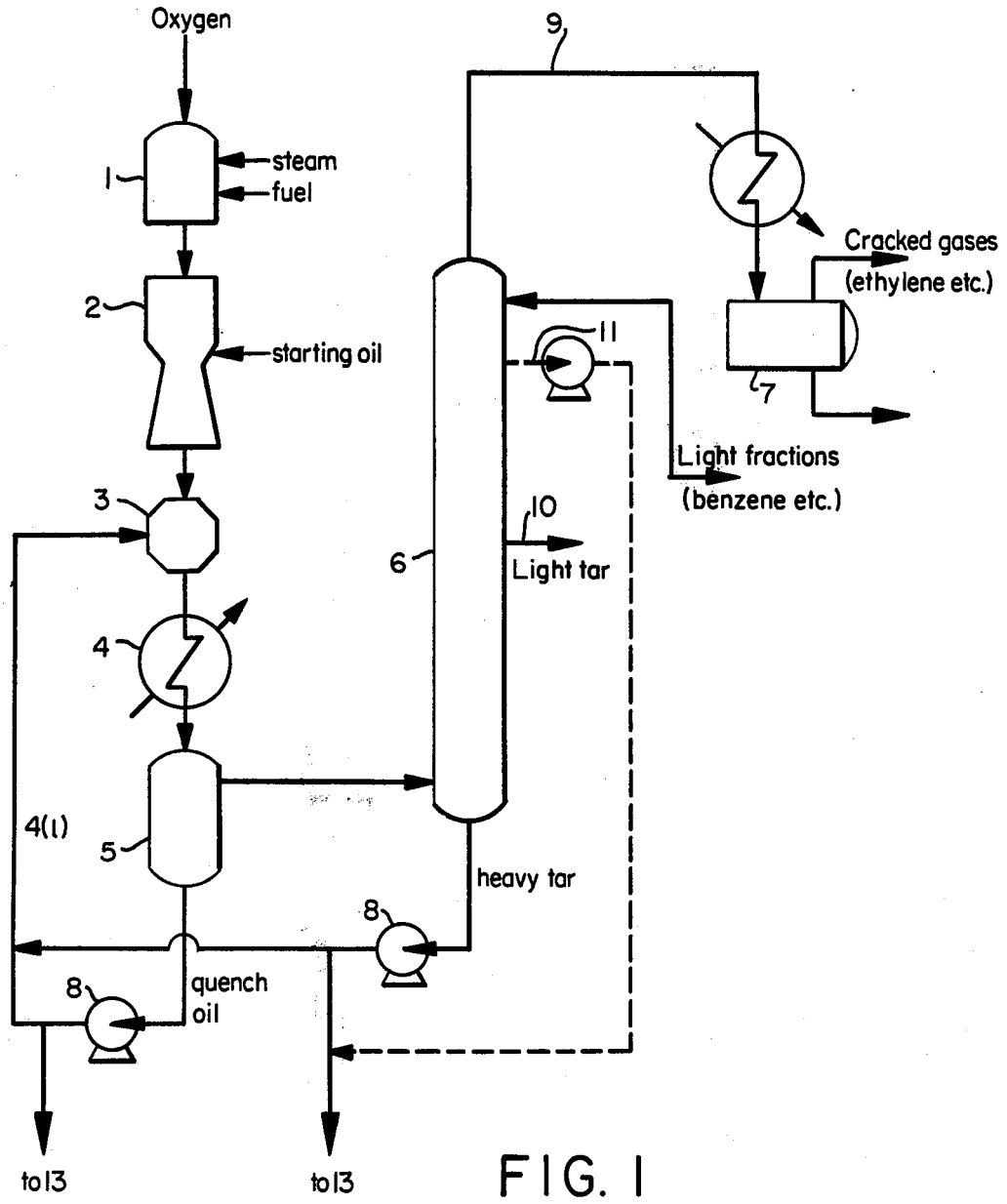
FIG. 1 is a flow sheet showing the ACR thermal cracking process for treating starting oils.

Further, olefins may be added to the tar pitch process according to the present invention in order that the conversion of tar into pitch is accelerated or unstable olefins are converted to stable ones at the high temperature and high pressure conditions in this process (refer to 11 in FIG. 1). More particularly, such materials as indene, cyclopentadiene, styrene, methylstyrene formed and accumulated in the ACR thermal cracking process may be appropriately recycled in the process of the present invention so that they participate in the acceleration of pitch formation and are stabilized by themselves in this process, whereby the thermal stability of tar in the entire system of the ACR process is enhanced and consequently the entire system is stabilized, contributing to prevention of the fouling problem in the system.

The tar pitch treating process of the present invention will now be described in greater detail. The process is a process of producing pitch which comprises heat-treating tar pitch in a heater (typically, tubular and externally heated) at a temperature of about 450° C.-550° C. under a pressure of about 50-150 kg/cm$^2$(G) for about 1-15 minutes and then heat-treating the tar pitch in a soaker (typically, kettle-type) with or without agitator at a temperature of about 350°-450° C. under a pressure of about 0.5-10 kg/cm$^2$(G) for about 15 minutes-10 hours. More preferred ranges for the heater and soaker conditions are as follows.

| | | |
|---|---|---|
| Heater: | temperature: | 470°-520° C. |
| | Pressure: | 80-120 kg/cm$^2$(G) |
| | residence time: | 2-8 mins. |
| Soaker: | temperature: | 380°-420° C. |
| | pressure: | 0.5-5 kg/cm$^2$(G) |
| | residence time: | 0.5-5 hours |

It should be noted that these conditions may vary within the above ranges depending on the starting material and the specification of the product pitch.

The chemical reactions accompanying the present tar pitch process are complicated and depend on the origin of the starting material, pressure, time, concentration of pitch in liquid tar, etc. However, it is known that, in general, gasification, decomposition (decrease in the molecular weight), dealkylation, transfer of alkyl group, ring formation, polymerization and condensation take place in the temperature range of 350°-550° C. Evaporation and/or distillation step may be suitably combined with the present process so as to control the composition of the tar pitch flowing in the system. Thus, the distillation may be carried out prior to the heater, or after the soaker. However, the inlet condition of the process (that is, inlet of the heater) is so controlled that the pitch content in the tar pitch is in the range of 20-80 wt%, and preferably 25-60 wt%. Incidentally, FIG. 1 illustrates a manner of combination of distillation step in the ACR process and heater and soaker.

Figure 3:
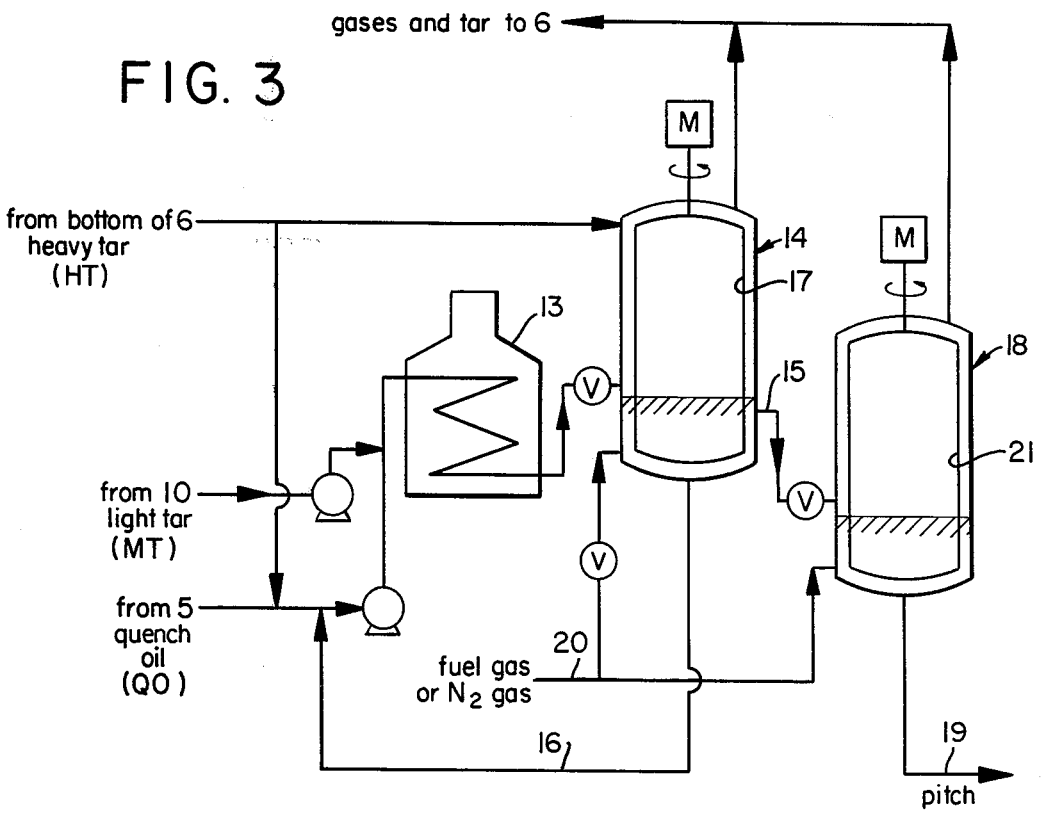

FIG. 3 illustrates one system for working the present invention. Tar pitch derived from the ACR process (refer to FIG. 1) is led first to a heater 13 and then to a soaker 14 from which the pitch is led through a line 15 to a softening point adjusting vessel 18. The heater 13 is preferably an externally heated tubular heater and treats the tar pitch under the conditions described hereinbefore. The soaker 14 is provided with a rotating agitator 17 and treats the tar pitch under the conditions as already prescribed. Element 21 is also a rotating agitator.

The outflowing streams from the tops of the soaker 14 and the softening point adjusting vessel 18 may be returned to the fractionator 6 (FIG. 1) for conditioning the tar pitch and for recovering gas constituents. Further, in order to control the process and the product, a portion of the output of the soaker 14 may be recycled as recycling stream 16 to the heater 13, or the light and/or heavy tar from the fractionator 6 may be fed to the heater 13 together with the quench oil stream. Further, the streams from the fractionator 6 may be first suitably heated and then added to the heater 13 or the quench stream 4 (l) for recycling. These recycles are an important factor in adjusting operational conditions of the process and the quality of the pitch and also to increase the yield. At least one recycle among them will be necessary in practice. Further, fuel gas or inert gas may be injected into the soaker or the softening point control vessel to control the pitch concentration or the softening point. The product pitch is withdrawn from 19. As seen from Table 4 and examples hereinafter described, a pitch of high CV value can be obtained without causing the viscosity to increase significantly.

In general, the properties of the pitch, which are required for various pitches including electrode binder pitch, are good graphitization, high density, high aromatic content, and thermal stability up to a relatively high temperature. The followings are considered as a typical industrial specification.

| | |
|---|---|
| Softening point: | 60°-130° C. |
| Fixed carbon: | >45 wt % |
| BI: | >20-50 wt % |
| QI: | <20 wt % |
| BI-QI: | >20 wt % |

These values are determined case by case by the requirements for the final products. The pitch produced according to the present invention can easily satisfy this specification.

From the foregoing, it has been made clear that the tar pitch process of the present invention provides a process for treating a tar pitch from the ACR thermal cracking process at relatively high temperatures and under relatively high pressure for relatively short periods of time, using a heater (tubular) and a soaker (kettle-type) and, if necessary, in combination with evaporation and fractionation and using the concept of the above-mentioned recycles to produce a pitch of high quality with high yield. Further, this process has an important feature over the conventional process in that the entire process can be relatively easily stabilized within a short period of time when the feedstock to the process varies or the operational conditions are changed because of the short average residence time in the process.

Although various types of starting material may be used in the present tar pitch process as already described, the tar pitches obtained from the ACR process using the starting oils as defined in this specification have "good birth" characterized by "high temperature and short time". On the other hand, the process of the present invention produces pitch products of superior quality from various tar pitches because of their "breeding" characterized by "relatively high temperature, high pressure and short time".

The present invention will be fully understood from the following examples.

MANUFACTURING EXAMPLE 1

According to the process flow as shown in FIG. 1, tar pitch was prepared. All distillates of Arabian light crude oil having the properties listed in Table 1 were introduced into an ACR pilot plant of a capacity of 100 kg per hour and light tar, heavy tar and quench oil were obtained. They had the fractions as shown in Table 2. The operational conditions of the ACR plant were as follows. Steam temperature at the burner 1: about 2,000° C., the weight ratio of the steam to the introduced starting oil (S/F): 1.5, temperature of the outlet of the reactor 2: 890° C., reaction time: 14.5 m sec., temperature of separator 5: about 300° C., temperature of the bottom of the fractionator 6: 283° C., pressure of the bottom of the fractionator: 3.0 kg/cm$^2$(G), temperature of the top of the fractionator: 136° C. The yield of the gaseous product was as shown in Table 3. The cracked gas had a ethylene/acetylene ratio of about 15. The pitch content in the product tar pitch was about 27 wt%.

From the heavy tar and the quench oil in Table 2 produced in Manufacturing Example 1, tar pitch formulations 1 and 2 were prepared by mixing them in suitable ratios. The prepared tar pitch formulations are shown in Table 4.

TABLE 1

| Arabian Light Crude Distillate (Total Distillates) | |
|---|---|
| Specific gravity | 0.824 |
| S content | 0.89% |
| C.C.R. (Conradson carbon) | 0.37% |
| I.B.P. | 30° C. |
| 50% | 264° C. |
| E.P. | 538° C. |

TABLE 2

| | Tar Pitch | | |
|---|---|---|---|
| | Light tar | heavy tar | quench oil |
| IBP | 150° C. | 260° C. | 300° C. |
| 10% | 206 | 296 | 350 |
| 50 | 260 | 360 | 474 |
| 90 | 340 | 480 | |
| 95 | 380 | 510 | |

Tar pitch yield (with respect to starting oil)
5.5 wt % + 2.5 wt % + 12 wt % = 20 wt % (total)
(light tar) (heavy tar) (quench oil)

TABLE 3

| Cracked Gas Products (with respect to starting oil) | |
|---|---|
| $H_2$, $CH_4$ | 10.0 wt % |
| $C_2H_2$ | 2.1 |
| $C_2H_4$ | 31.7 |
| $C_2H_6$ | 2.4 |
| $C_3H_4$ | 0.9 |
| $C_3H_6$ | 9.6 |
| $C_3H_3$ | 0.4 |
| $C_4H_4$ | 0.2 |
| $C_4H_6$ | 4.3 |
| $C_4H_8$ | 2.0 |
| $C_4H_{10}$ | 0.1 |
| C as CO, $CO_2$ and $H_2S$ | 1.5 |
| $C_5$ - 160° F. | 3.6 |
| $C_6$-$C_8$ Aromatic | 9.2 |
| $C_6$-$C_8$ Non-aromatic | 1.8 |
| $C_9$ - | 0.6 |
| Total | 80 wt % |

TABLE 4

| | | Tar Pitch Formulation 1 (heavy tar + quench oil) 2.5 : 12 | Tar Pitch Formulation 2 (heavy tar + quench oil) 5 : 12 |
|---|---|---|---|
| 1 | IBP-350° C. | 21.8 wt % | 6.2 wt % |
| | 350-550° C. | 41.0 | 54.0 |
| | 550° C. + | 37.2 | 39.8 |
| 2 | 400° C. + | 60.3 | 64.5 |
| | Properties of 400° C. + | SP 120° C. | 121° C. |
| | | BI 10.2 wt % | 11.0 wt % |
| | | QI 0 | 0 |
| | | CV 31.1 wt % | 32.2 wt % |

EXAMPLE 1

The tar pitch obtained in Manufacturing Example 1 was processed according to the process flow illustrated in FIG. 3, using an experimental system having a capacity of 1.5 kg/hr.

The heater 13 was an externally heated tube heater, the soaker 14 was a kettle type vessel (although FIG. 3 is a flow sheet of a practical plant, the experiment was performed in a system of laboratory scale and the adjustment of the softening point was performed in a usual distillator). The operational conditions in the heater were as follows: outlet temperature of the tube heater 13: 500° C., pressure in the tube heater: 100 kg/cm$^2$(G), residence time in the heater: 5.5 min. Tar pitch formulation 1 in Table 4 prepared by mixing heavy tar and quench oil was introduced into the experimental system. Thus, the tar pitch used here corresponds to the bottom oil (a mixture of quench oil and bottom heavy oil from the fractionator) in FIG. 1, which is fed to the heater. The treated tar pitch was then introduced into the soaker and treated at a temperature of 400° C. under a pressure of 6 kg/cm$^2$(G) at a residence time of 1 hour. From the top of the soaker, 4.0 wt% pf a by-product gas (gaseous at normal temperature and normal pressure) was discharged and the yield of 360° C.+(1 atm) in the liquid product was 61.5 wt%. This 360° C.+is the product pitch.

The pitch exhibited the following properties.

| | |
|---|---|
| SP (softening point) (R & B)* | 121° C. |
| BI (benzene insoluble)* | 34.8 wt % |
| QI (quinolin insoluble)* | 1.2 wt % |
| CV (carbon value)* | 49.6 wt % |

*Note:
R & B, BI, QI .... Japan Industrial Standard No. K-2425
Carbon value .... Japan Industrial Standard No. M-8812

The pitch obtained in this example exhibited superior properties as binder pitch for carbon electrode. As is seen from this example, a pitch of high quality for such as binder is obtained with a high yield of 61.5 wt%.

EXAMPLE 2

Using the same system and the same tar pitch formulation as in Example 1, the first step treatment was effected at a heater outlet temperature of 500° C. under a tube heater pressure of 50 kg/cm$^2$(G) at a heater residence time of 5.5 min. and then the second step treatment was effected at a soaker temperature of 400° C. under a pressure of 6 kg/cm$^2$(G) at a soaker residence time of 1 hr. The by-product gas discharged from the top of the soaker was 3.6 wt% based on the starting tar pitch and the yield of 360° C.+in the liquid product was 60.2%. The pitch thusly produced had the following properties and met the standard of electrode binder pitch.

| | |
|---|---|
| SP (R & B) | 120° C. |
| BI | 33.7 wt % |
| QI | 1.1 wt % |
| CV | 48.1 wt % |

EXAMPLE 3

Using the same system and the same tar pitch formulation in Example 1, the first step treatment was effected at a heater outlet temperature of 470° C., under a heater pressure of 100 kg/cm$^2$(G) at a residence time of 10 min. and then the second step was effected at a soaker temperature of 400° C. under a soaker pressure of 6 kg/cm$^2$(G) at a soaker residence time of 2.5 hrs. The by-product gas was 3.9 wt% based on the starting tar pitch and the yield of the pitch content, i.e. 360° C.+in the liquid product was 61.0%. The properties were as follows and the pitch was satisfactory as a binder for electrode.

| | |
|---|---|
| SP | 120° C. |
| BI | 34.1 wt % |
| QI | 1.4 wt % |
| CV | 49.0 wt % |

EXAMPLE 4

Using the same system and the same starting tar pitch formulation as in Example 1, the first step was effected at a heater outlet temperature of 450° C. under a heater pressure of 100 kg/cm$^2$(G) at a residence time of 10 min. and then the second treatment was effected at a soaker temperature of 400° C. under a soaker pressure of 6 kg/cm$^2$ at a residence time of 5 hrs. The by-product gas was 1.9 wt% based on the starting tar pitch formulation and the yield of 400° C.+pitch was 54.9 wt% and the properties were as follows.

| | |
|---|---|
| SP | 117° C. |
| BI | 25.3 wt % |
| QI | 0.3 wt % |
| CV | 46.2 wt % |

Comparing this example with Example 3, the BI content and the pitch yield tend to be lowered at a heater outlet temperature of 450° C. even if the other conditions are the same. Also, it is seen that the lowering of the pitch yield cannot be compensated by a longer residence time in the soaker. The product pitch was not acceptable for a binder pitch but was satisfactory as an impregnation pitch for electrode.

EXAMPLE 5

Using the same system and the same tar pitch formulation as in Example 1, the first step was effected at a heater outlet temperature of 500° C. under a heater pressure of 100 kg/cm$^2$(G) at a residence time of 2.5 min. and the second step was effected at a soaker temperature of 425° C. under a pressure of 6 kg/cm$^2$(G) at a residence time of 1 hr. The by-product gas was 3.8 wt%, the yield of 360° C.+pitch was 60.3 wt% and the properties were as follows which was satisfactory as electrode binder.

| | |
|---|---|
| SP | 120° C. |
| BI | 35.2 wt % |
| QI | 1.7 wt % |
| CV | 49.2 wt % |

EXAMPLE 6

Using the same apparatus and the same tar pitch formulation as in Example 1, the first step was effected at a heater outlet temperature of 525° C. under a pressure of 100 kg/cm$^2$(G) at a residence time of 1 min. and the second step was effected at a soaker temperature of 400° C. under a soaker pressure of 6 kg/cm$^2$(G) at a residence time of 1 hour. The by-product gas was 3.7 wt% and the yield of 360° C.+pitch was 60.0 and the properties were as follows, which were satisfactory as a binder for electrode.

| | |
|---|---|
| SP | 121° C. |
| BI | 33.6 wt % |
| QI | 0.9 wt % |
| CV | 49.1 wt % |

EXAMPLE 7

Using the same system and the same tar pitch formulation as in Example 1, the first step was effected at a heater temperature of 500° C., under a heater pressure of 100 kg/cm$^2$(G) at a residence time of 1 min. and the second step was effected at a soaker temperature of 425° C. under a soaker pressure of 6 kg/cm$^2$(G) at a residence time of 1.5 hr. The by-product gas was 1.8 wt%, and the yield of 400° C.+pitch was 54.3 wt% and the properties were as follows.

| | |
|---|---|
| SP | 119° C. |
| BI | 23.5 wt % |
| QI | 0.5 wt % |
| CV | 45.8 wt % |

The pitch is satisfactory as an inpreparation pitch.

Comparing this example with Example 5, it is seen that, at such short heater residence time as 1 min., the QI content and the pitch yield tend to be lowered even if the other conditions are the same.

EXAMPLE 8

Using the same apparatus as in Example 2 and using the tar pitch formulation 2 in Table 4, the first step was effected at a heater outlet temperature of 500° C. under a heater pressure of 100 kg/cm$^2$(G) at a residence time of 5 mins. and then the second step was effected at a soaker temperature of 400° C. under a soaker pressure of 6 kg/cm$^2$(G) at a residence time of 1.5 hr. The by-product gas was 3.8 wt% and the yield of 240° C.+pitch was 65.2 wt% and the properties were as follows.

| | |
|---|---|
| SP | 121° C. |
| BI | 33.0 wt % |

-continued

| | |
|---|---|
| QI | 1.5 wt % |
| CV | 49.2 wt % |

The pitch was satisfactory as binder pitch. Incidentally, this example corresponds to the case where the conditions of the bottom oil (an mixture of quench oil and heavy tar from the fractionator) in FIG. 1 are changed. This can be materialized by, for example, changing the recycling stream from the fractionator to the quencher.

Although the above examples were described in relation to production of pitches for carbonatious electrode industries, a person skilled in the art will readily understand that the present invention is not restricted to pitches for carbonaceous electrode industries but can be applied to the production of pitches for other purposes, without departing from the spirit of the present invention.

What is claimed is:

1. A process for producing various pitches of high quality, which comprises the steps of: (a) adiabatically thermally cracking a starting oil in an ACR thermal cracking process at a temperature between 700° C. and 1000° C. to produce gases containing ethylene, propylene, and the like and a tar pitch having a pitch content controlled within the range of between 20 and 80 wt%; (b) heat-treating said controlled tar pitch in a heater at a temperature between about 450° C. and about 550° C. under a pressure between about 50 and 150 kg/cm$^2$(G) for about 1 to 15 minutes; and (c) subsequently treating it in a soaker at a temperature between about 350° and about 450° C. under a pressure between about 0.5 and about 10 kg/cm$^2$(G) for about 15 minutes to 10 hours.

2. The process according to claim 1, wherein said pitch content is controlled within the range between 25 and 60 wt%.

3. The process according to claim 1, wherein the temperature in the heater is about 470°–520° C., the pressure is about 80–120 kg/cm$^2$(G), and the residence time is about 2–8 minutes.

4. The process according to claim 1, wherein the temperature in the soaker is about 380°–420° C., the pressure is about 0.5–5 kg/cm$^2$(G) and the residence time is about 0.5–5 hours.

5. The process according to claims 1–4 wherein a part of the tar or tar pitch in the process is recycled to the inlet of the heater.

* * * * *